US010549350B2

(12) United States Patent
Uhlenhut et al.

(10) Patent No.: US 10,549,350 B2
(45) Date of Patent: Feb. 4, 2020

(54) PROCESS FOR PRODUCING SHAPED REFRACTORY METAL BODIES

(71) Applicant: H.C. STARCK HERMDORF GMBH, Hermsdorf OT (DE)

(72) Inventors: Henning Uhlenhut, Jena (DE); Uwe Blumling, Tautenheim (DE); Klaus Andersson, Kahla (DE); Bernd Dobling, Schleiz (DE); Michael Svec, Schonwald (DE); Karl-Hermann Buchner, Hof (DE)

(73) Assignee: H.C. STARCK HERMDORF GMBH, Hermsdorf (DE)

( * ) Notice: Subject to any disclaimer, the term of this patent is extended or adjusted under 35 U.S.C. 154(b) by 567 days.

(21) Appl. No.: 15/263,602

(22) Filed: Sep. 13, 2016

(65) Prior Publication Data

US 2017/0050244 A1 Feb. 23, 2017

Related U.S. Application Data

(63) Continuation of application No. 12/305,740, filed as application No. PCT/EP2007/055986 on Jun. 18, 2007, now abandoned.

(30) Foreign Application Priority Data

Jun. 22, 2006 (DE) ..... 10 2006 029 101

(51) Int. Cl.

| | |
|---|---|
| ***B22F 5/06*** | (2006.01) |
| ***B22F 5/00*** | (2006.01) |
| ***B22F 3/22*** | (2006.01) |
| ***C22C 27/04*** | (2006.01) |
| ***B22F 1/00*** | (2006.01) |
| ***B22F 3/10*** | (2006.01) |
| ***B22F 3/24*** | (2006.01) |

(Continued)

(52) U.S. Cl.

CPC ..... *B22F 5/006* (2013.01); *B22F 1/0074* (2013.01); *B22F 3/1021* (2013.01); *B22F 3/22* (2013.01); *B22F 3/24* (2013.01); *B22F 9/04* (2013.01); *C22C 27/04* (2013.01); *C22F 1/18* (2013.01); *B22F 2003/248* (2013.01); *B22F 2009/043* (2013.01); *B22F 2301/20* (2013.01); *B22F 2998/10* (2013.01); *Y10T 428/12* (2015.01); *Y10T 428/12479* (2015.01)

(58) Field of Classification Search

CPC ..... B22F 5/006

See application file for complete search history.

(56) References Cited

U.S. PATENT DOCUMENTS

| | | | |
|---|---|---|---|
| 3,155,502 | A | 11/1964 | Brown |
| 3,324,699 | A | 6/1967 | Barto |

(Continued)

FOREIGN PATENT DOCUMENTS

| | | |
|---|---|---|
| EP | 0325179 | 1/1989 |
| EP | 05799911 A2 | 1/1994 |
| WO | 2005073418 A1 | 8/2005 |

OTHER PUBLICATIONS

K.H. Eckelmeyer and S.G. Caldwell, "Very High Density Metals," Metals Handbook Desk Edition, ASM International, 1998, p. 691-695, as excerpted in ASM Handbooks Online.

*Primary Examiner* — Christopher S Kessler

(74) *Attorney, Agent, or Firm* — Morgan, Lewis & Bockius LLP

(57) ABSTRACT

The present invention relates to a process for producing shaped articles composed of refractory metals.

29 Claims, 6 Drawing Sheets

(51) Int. Cl.

| | |
|---|---|
| ***B22F 9/04*** | (2006.01) |
| ***C22F 1/18*** | (2006.01) |

(56) References Cited

U.S. PATENT DOCUMENTS

| | | | |
|---|---|---|---|
| 3,403,009 | A | 9/1968 | Bergstrom |
| 4,491,559 | A | 1/1985 | Grab et al. |
| 4,777,015 | A | 10/1988 | Kemp, Jr. et al. |
| 6,447,715 | B1 | 9/2002 | Amick |
| 2007/0172378 | A1 | 7/2007 | Shibuya et al. |

Figure 7a: Color code

PROCESS FOR PRODUCING SHAPED REFRACTORY METAL BODIES

RELATED APPLICATIONS

This application is a continuation of U.S. patent application Ser. No. 12/305,740, filed May 3, 2011, now abandoned, which is the U.S. national stage application of International (PCT) patent application Ser. No. PCT/EP2007/055986, filed Jun. 18, 2007, which claims the benefit of German Application No. 102006029101.8, filed Jun. 22, 2006. The entire disclosure of each of these applications is hereby incorporated by reference.

TECHNICAL FIELD

The present invention relates to a process for the production of shaped articles comprising refractory metals, in particular metal sheets comprising tungsten or molybdenum.

BACKGROUND

Owing to their high density of 17 to 18.6 g/cm$^3$, tungsten heavy metal alloys are suitable for screening short-wave electromagnetic radiation. They are therefore frequently used for radiation protection or for beam guidance in X-ray devices. Other applications are, for example, counterweights in the aviation and automotive industry or mold components for aluminum die casting molds.

Tungsten heavy metal alloys consist of about 90% by weight to about 97% by weight of tungsten. The remaining proportion comprises binder metals. Such metal sheets are commercially available in thicknesses of about 0.4 mm to about 1.2 mm, but, because of roll treatment, have anisotropic material properties and an anisotropic microstructure (based on tungsten).

Tungsten heavy metal components are generally sintered close to the final shape and then machined or, in the case of flat components, produced from metal sheets.

Various problems occur in the production of tungsten heavy metal sheets and also sheets comprising molybdenum alloys:

- In general, only very limited rolling can be introduced between two annealing steps. In the case of excessive rolling, the metal sheets break and become unusable. Typical, permitted degrees of deformation are below 20% between two annealing steps. In the case of metal sheet thicknesses below 0.4 mm, it is necessary to carry out more than 4 annealings. This makes the process significantly more complicated if it is intended to produce thin metal sheets.
- Owing to their length, the rolled, thin metal sheets can be annealed only with difficulty in customary production furnaces. Space-saving rolling up cannot be carried out owing to the brittleness of the metal sheets, so that in general a large number of small metal sheets has to be processed. As a result of this, the production of thin metal sheets having a thickness of 0.5 mm or less is significantly more complicated.
- As a result of the production process, the known metal sheets exhibit anisotropic, i.e. direction-dependent, material properties within the plane of the metal sheet and a texture in which the <100> and <110> directions are oriented parallel to the normal of the metal sheet.

SUMMARY

It was the object of the present invention to provide a technically simpler production process for such metal sheets having a small thickness.

This object is achieved by a process for the production of shaped articles comprising a tungsten heavy metal alloy and comprising molybdenum alloys, a slip for foil casting being produced from a tungsten heavy metal alloy or molybdenum alloy, a foil being cast from the slip, and the foil being freed of binder after drying and being sintered to obtain a metal sheet. The shaped article according to the invention is generally a metal sheet or is obtainable from a metal sheet by, for example, punching, embossing or forming. Further suitable shaping methods for obtaining the shaped article are, for example, bending, water-jet or laser cutting, spark erosion and machining.

In the context of the present invention, the term tungsten heavy metal alloy or molybdenum alloy is understood to mean materials selected from the group consisting of tungsten heavy metal alloys, tungsten, tungsten alloys, molybdenum and molybdenum alloys. The process according to the invention can therefore advantageously be used for numerous materials.

It was a further object to provide a shaped article comprising a tungsten heavy metal alloy or molybdenum alloy which has an isotropic microstructure based on tungsten or molybdenum, which article has isotropic properties. The articles obtained by the process according to the invention have these features and therefore achieve this object.

BRIEF DESCRIPTION OF THE DRAWINGS

FIG. 7*a* depicts the color code for FIG. 7;

DETAILED DESCRIPTION

Figure 1:
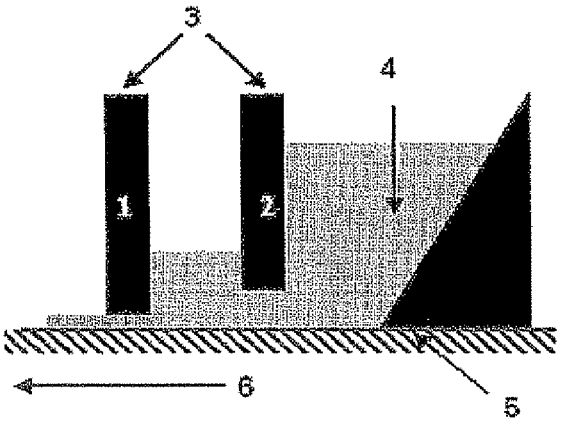
FIG. 1 depicts a foil casting unit that has a double-chamber casting shoe in accordance with various embodiments of the invention.

Foil casting is an economical process for the production of planar components for a very wide range of applications in the electrical industry, such as, for example, chip substrates, piezo actuators and multilayer capacitors. In recent years, however, interest in foil casting for other, novel product areas has increased greatly. The economical production of large-area, flat, thin, defect-free and homogeneous substrates which have sufficient green strength, narrow dimensional tolerances and a smooth surface is extremely difficult or even impossible with conventional processes for the production of ceramic components, such as dry pressing, slip casting or extrusion.

According to the prior art to date, the process for the production of metal sheets comprising tungsten heavy metal alloys or molybdenum alloys generally comprises the following steps:

- mixing of metal powder (e.g. tungsten and metallic binder)
- milling
- pressing
- sintering
- multiple repetition of the steps
- rolling
- annealing
- until the desired metal sheet thickness is reached
- straightening The metal sheets are then processed to give the desired component. Suitable shaping methods are, for example, bending, water-jet or laser cutting, spark erosion and machining.

In the process according to the invention, a slip for foil casting is produced from a tungsten heavy metal alloy or molybdenum alloy, a foil is cast from the slip, and the foil is freed from binder and sintered after drying in order to obtain the shaped article. The process according to the invention is in particular a process for the production of shaped articles comprising a tungsten heavy metal alloy or molybdenum alloy, comprising the steps

- provision of a powder comprising a tungsten heavy metal alloy or molybdenum alloy;
- mixing with solvent, dispersant and optionally polymeric binder in order to obtain a first mixture;
- milling and homogenization of the first mixture;
- addition of plasticizer and optionally further solvent and/or polymeric binder in order to obtain a second mixture;
- homogenization of the second mixture;
- degassing of the second mixture;
- foil casting of the second mixture;
- drying of the cast foil;
- removal of binder from the cast foil;
- sintering of the foil in order to obtain a first heavy metal sheet.

In an advantageous embodiment of the invention, the process additionally comprises the steps

- rolling and annealing of the first heavy metal sheet in order to obtain a second heavy metal sheet;
- optionally repetition of the rolling and annealing until the desired surface structure and thickness are achieved;
- straightening of the second heavy metal sheet.

In the process according to the invention, tungsten metal powder or molybdenum metal powder is first mixed with a metallic binder, likewise in the form of a metal powder. The metallic binder is usually an alloy containing metals selected from the group consisting of nickel, iron, copper with one another or with other metals. Alternatively, it is also possible to use an alloy of tungsten or molybdenum with the metallic binder in the form of a metal powder. Nickel/iron and nickel/copper alloys can advantageously be used as metallic binders.

The metallic binder consists as a rule of nickel, iron, copper, cobalt, manganese, molybdenum and/or aluminum. The tungsten or molybdenum content is from 60% by weight to 98% by weight, advantageously from 78% by weight to 97% by weight, in particular from 90% by weight to 95% by weight or from 90.2% by weight to 95.5% by weight.

The nickel content is from 1% by weight to 30% by weight, advantageously from 2% by weight to 15% by weight or from 2.6% by weight to 6% by weight or from 3% by weight to 5.5% by weight.

The iron content is from 0% by weight to 15% by weight, advantageously from 0.1% by weight to 7% by weight, in particular from 0.2% by weight to 5.25% by weight or from 0.67% by weight to 4.8% by weight.

The copper content is from 0% by weight to 5% by weight, advantageously from 0.08% by weight to 4% by weight, in particular from 0.5% by weight to 3% by weight or from 0.95% by weight to 2.1% by weight.

The cobalt content is from 0% by weight to 2% by weight, advantageously from 0.1% by weight to 0.25% by weight or from 0.1% by weight to 0.2% by weight.

The manganese content is from 0% by weight to 0.15% by weight, advantageously from 0.05% by weight to 0.1% by weight. The aluminum content is from 0 to 0.2% by weight, advantageously from 0.05 to 0.15% by weight, or 0.1% by weight. Advantageously, the tungsten content is from 60 1% by weight to 30% by weight to 80% by weight to 30% by weight if only iron and nickel are used as metallic binder. In this case, optionally from 0 to 0.2% by weight of aluminum may be advantageous.

The tungsten powder or molybdenum powder or alloy powder advantageously has a specific surface area of about 0.1 $m^2/g$ to about 2 $m^2/g$, and the particle size is generally less than 100 μm, in particular less than 63 μm. This mixture is then introduced into a solvent which preferably contains a dispersant and is then deagglomerated, for example in a ball mill or another suitable apparatus.

The dispersant prevents the agglomeration of the powder particles, reduces the viscosity of the slip and leads to a higher green density of the cast foil. Polyester/polyamine condensation polymers, such as, for example, Hypermer KD1 from Uniqema, are advantageously used as the dispersant; however, further suitable materials are known to the person skilled in the art, such as, for example, fish oil (Menhaden Fish Oil Z3) or alkyl phosphate compounds (ZSCHIMMER & SCHWARZ KF 1001).

Polar organic solvents, such as, for example, esters, ethers, alcohols or ketones, such as methanol, ethanol, n-propanol, n-butanol, diethyl ether, tert-butyl methyl ether, methyl acetate, ethyl acetate, acetone, ethyl methyl ketone or mixtures thereof, can advantageously be used as solvents. An azeotropic mixture of two solvents, for example a mixture of ethanol and ethyl methyl ketone in the ratio of 31.8:68.2 percent by volume, is preferably used as the solvent.

This mixture is, for example, milled in a ball mill or another suitable mixing unit and homogenized thereby. This process is generally carried out for about 24 hours when the first mixture is thus obtained.

The polymeric binder can be added during the preparation of the first mixture, optionally with further solvent and if appropriate a plasticizer. In an alternative embodiment, the polymeric binder can also be added during the preparation of the second mixture. In an alternative embodiment, the polymeric binder can be added both partly during the preparation of the first mixture and partly during the preparation of the second mixture. This variant has the advantage that, after addition of a part of the polymeric binder to the first mixture, this mixture is more stable and shows less sedimentation or no sedimentation.

In general, a mixture of plasticizer, polymeric binder and solvent is added. The same solvents as those described above can be added here. Alternatively, a solvent or solvent mixture can be used for the preparation of the first mixture and the polymeric binder can be added with another solvent or solvent mixture, so that a desired solvent mixture (e.g. an azeotropic mixture) is established only after the addition of the polymeric binder.

The polymeric binder must meet many requirements. It serves predominantly for binding individual powder particles to one another during drying, should be soluble in the solvent and should be readily compatible with the dispersant. The addition of the polymeric binder greatly influences the viscosity of the slip. Advantageously, it causes only a slight increase in viscosity and at the same time has a stabilizing effect on the dispersion. The polymeric binder must burn out without leaving a residue. In addition, the polymeric binder ensures good strength and handling properties of the green foil. An optimum polymeric binder reduces the tendency for cracks in the green foil on drying and does not hinder solvent evaporation by the formation of a dense surface layer. In general, polymers or polymer preparations having a low ceiling temperature can be used as polymeric binders, such as, for example, polyacetal, polyacrylates or polymethacrylates or copolymers thereof (acrylate resins, such as ZSCHIMMER & SCHWARZ KF 3003 and KF 3004), and polyvinyl alcohol or derivatives thereof, such as polyvinyl acetate or polyvinyl butyral (KURARY Mowital SB 45 H, FERRO Butvar B-98, and B-76, KURARY Mowital SB 60 H).

Plasticizers used are additives which result in greater flexibility of the green foil by reducing the glass transition temperature of the polymeric binder.

The plasticizer penetrates into the network structure of the polymeric binder, which results in the intermolecular resistance to friction and hence to the viscosity of the slip being reduced. By establishing a suitable plasticizer/binder ratio and by combination of various plasticizer types, it is possible to control foil properties such as tensile strength and extensibility.

An advantageously used plasticizer is a benzyl phthalate (FERO Santicizer 261A).

Binder and plasticizer can be added as binder suspension or binder solution to the. The binder suspension is advantageously composed of polyvinyl butyral and benzyl phthalate in a ratio of 1:1, based on weight.

After the addition of the polymeric binder, optionally with further solvent and optionally with plasticizer, the second mixture is obtained.

The second mixture has a solids content of about 30 to percent by volume. The proportion of solvent is generally less than 45 percent by volume. The proportion of organic compounds differing from the solvent, such as polymeric binder, dispersant and plasticizer, is generally 5 to 15 percent by volume in total. Depending on the composition, the second mixture has a certain viscosity which is in the range from 1 Pa·s to 7 Pa·s.

Said mixture is homogenized—generally for a further 24 hours—in a suitable mixing unit, such as ball mill.

After the homogenization of the second mixture, the latter is conditioned and degassed in casting batches. The conditioned slip is slowly stirred in a special pressure container and evacuated under reduced pressure. This is a customary process step which is known in principle to the person skilled in the art so that the optimum conditions can be discovered with a small number of experiments. The slip thus obtained or the homogenized, conditioned and degassed second mixture is then used for foil casting.

In the simplest case, the slip is cast on a substrate and brought to a certain thickness by means of a doctor blade.

A foil casting unit which has a casting shoe shown in FIG. 1 can also advantageously be used. In FIG. 1, the slip 4 is introduced and is brought to the desired thickness by drawing the substrate 5 in the drawing direction 6 through the casting blades 3. A substrate which can advantageously be used is a plastic film which is silicone-coated on one side and consists, for example, of PET (polyethylene terephthalate); however, other films which can resist the forces occurring during drawing and have little adhesion to the dried slip are in principle also suitable. The surface of the film may also be structured in order to impart the surface structure to the finished metal sheet. For example, silicone-coated PET films having a thickness of about 100 μm are suitable.

For a slip having constant properties, the thickness of the cast foil depends on the blade height, on the hydrostatic pressure in the casting shoe and on the drawing speed. In order to achieve a constant hydrostatic pressure, the slip height must be kept constant by means of appropriate filling and level regulation. The double-chamber casting shoe shown in FIG. 1 improves the maintenance of a constant hydrostatic pressure in the second chamber which is formed by the blades 1 and 2 and permits very exact maintenance of a desired foil thickness. In general, foils up to 40 cm wide can be cast without problems. The belt speed varies between 15 m/h (meters per hour) and 30 m/h. The set blade heights depend on the desired foil thickness and are between 50 μm and 2000 μm, in particular between 500 μm and 2000 μm.

In general, the foil thickness after drying is about 30% of the blade height. The thickness of the sintered metal sheets is dependent on the z-shrinkage during sintering. The shrinkage of the dried foil during sintering is about 20%. The cast metal powder foils dry continuously in the drying tunnel of the casting unit in a temperature range of 25-70° C. Air flows counter currently through the drying tunnel. The high solvent vapor concentrations during drying necessitate a drying tunnel which complies with the explosion protection guidelines.

The exact process conditions depend on the composition of the slip used and the parameters of the foil casting unit used. The person skilled in the art can discover the suitable settings by a small number of routine experiments.

In order to produce differently shaped articles, the foil can be processed, for example, by cutting, punching or machining. This makes it possible, for example, to obtain thin welding rods, rings, crucibles, boats or isotope containers.

For articles having a more complicated shape, cut-out foil parts can also be folded or assembled to give tubes, boats or larger crucibles, it also being possible to adhesively bond the foil. For example, unconsumed slip or unconsumed binder suspension can be used as adhesive. The article obtained from the foil can then be subjected to the further process steps.

After the drying of the foil, binder is removed from the latter. Removal of binder means as far as possible residue-free removal of all organic constituents required for foil casting, such as polymeric binder and plasticizer, from the material. If residues remain behind in the form of carbon, this leads to the formation of carbides, for example of tungsten carbide, in the following sintering process.

Figure 2:
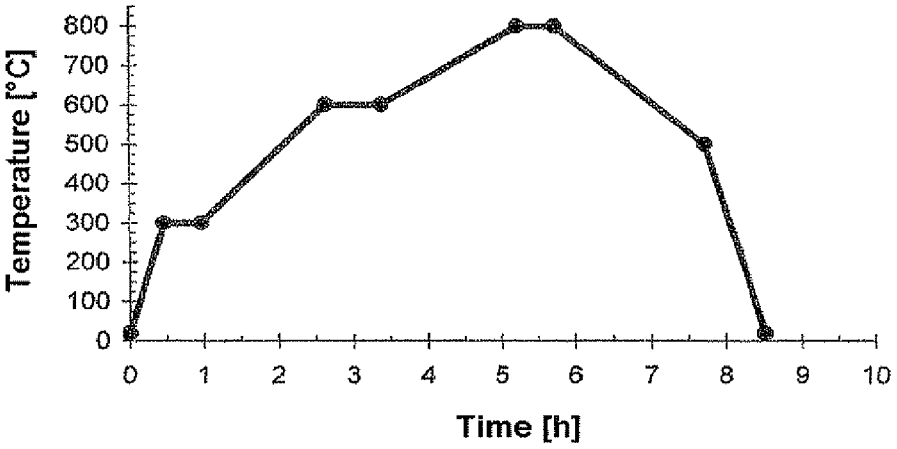
FIG. 2 depicts an exemplary temperature profile for binder removal in accordance with various embodiments of the invention.

The removal of binder is effected in a thermal process. Here, the foils are heated using a suitable temperature profile. FIG. 2 shows by way of example a suitable temperature profile. As a result of the heating, the organic constituents are first softened and may become liquid. Polymeric constituents, such as the polymeric binder or the dispersant, are advantageously depolymerized, and it is for this reason that, as mentioned above, a low ceiling temperature of these components is advantageous. With increasing temperature, these liquid phases should evaporate and should be removed via the atmosphere. The temperature should increase so rapidly that no sparingly volatile crack products form. These lead to carbon deposits in the form of carbon black.

For increasing the vapor pressure, heating is effected up to 600° C. under a vacuum of 50-150 mbar absolute, with the result that better evaporation of the liquid phase is achieved.

For transporting away the vaporized organic constituents, the atmosphere in the furnace space must be flushed. Nitrogen having a proportion of about 2% by volume of hydrogen or less is used for this purpose. The proportion of hydrogen advantageously ensures that the furnace atmosphere is free of oxygen and oxidation of the metal powders is avoided.

The removal of binder is complete at up to about 600° C. The components at this stage are a weakly bound powder packing. In order to achieve initial sintering of the powder particles, the thermal process is raised to about 800° C. Very brittle components which can be handled and can be subjected to the following sintering step form.

After removal of the binder, the foil is sintered. Depending on the alloy composition, the sintering temperature is between 1300° C. and about 1600° C., in particular 1400° C. and 1550° C. The sintering times are typically about 2 h to 8 h. Sintering is preferably effected in a hydrogen atmosphere, in vacuo or under inert gas, such as nitrogen or a noble gas, such as argon, possibly with admixture of hydrogen. After the sintering, a dense metal sheet having up to 100% of the theoretical density is present. The sintering can take place in a batch furnace or a pressure-type kiln. The initially sintered foils from which binder has been removed should be sintered on suitable sintering substrates. It is advantageous to weight the foils to be sintered with a smooth, flat covering so that warping of the foil during the sintering process is avoided. A plurality of foils can be placed on top of the other for this purpose, with the result that the sintering capacity is additionally increased. The stacked foils should preferably be separated by sintering substrates. Ceramic sheets or films which do not react with the tungsten heavy metal alloy under the sintering conditions are preferred as the sintering substrate. For example, the following are suitable for this purpose: alumina, aluminum nitride, boron nitride, silicon carbide or zirconium oxide. Furthermore, the surface quality of the sintering substrate is decisive for the surface quality of the foil to be sintered. Defects can be reproduced directly on the foil or can lead to adhesions during sintering. Adhesions frequently lead to cracking or to distortion of the foils since the shrinkage during sintering is hindered. For reducing the waviness and/or improving the surface quality, a rolling step can advantageously follow. The metal sheet can be rolled under conditions which are known from the prior art to date. Depending on thickness of the metal sheet, rolling is effected at between about 1100° C. and room temperature. Metal sheets having a thickness of about 2 mm are rolled at high temperatures, while foils can be rolled at room temperature. In the process according to the invention, in contrast to the prior art, the rolling serves however to a lesser extent for reducing the thickness but is intended especially to eliminate the waviness of the metal sheet and to improve the surface quality.

For the production of particularly thin metal sheets, however, rolling can also be effected for thickness reduction.

Finally, annealing can be carried out for reducing internal stresses. The annealing is generally carried out at temperatures of 600° C. to 1000° C. in vacuo or under an inert gas or reducing atmosphere. The steps of rolling and annealing can optionally be repeated until the desired surface quality and optionally thickness have been achieved.

The process according to the invention permits the production of shaped articles comprising a tungsten heavy metal alloy or molybdenum alloy, which have a thickness of less than 1.5 mm, in particular less than 0.5 mm, especially less than 0.4 mm. The density of the metal sheet is 17 g/cm$^3$ to 18.6 g/cm$^3$, preferably 17.3 g/cm$^3$ to 18.3 g/cm$^3$.

The process according to the invention permits the production of shaped articles comprising a tungsten heavy metal alloy or molybdenum alloy, which has an isotropic microstructure based on tungsten or molybdenum. According to the invention, an isotropic microstructure is understood as meaning a uniform mixture of the crystallographic orientations without preferred orientation, and an approximately round particle shape of the tungsten phase or molybdenum phase.

Figure 11:
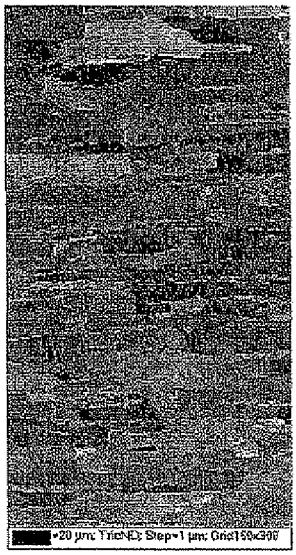
FIG. 11 depicts the crystallographic texture of a comparative tungsten heavy metal sheet, as determined by EBSD measurements.
Figure 12:
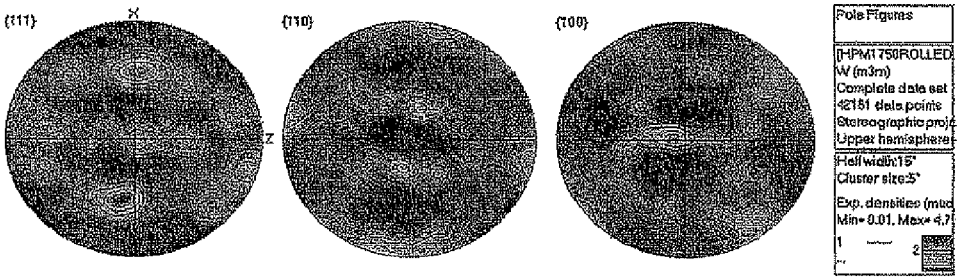
FIG. 12 depicts the crystallographic texture of a comparative tungsten heavy metal sheet in the form of pole figures.

Metal sheets and foils which are produced according to the prior art by rolling preferably have <100> and <110> orientations parallel to the normal direction of the metal sheet (cf. FIG. 11). These preferred orientations are part of a typical rolling structure, as can be seen from the pole figures (cf. FIG. 12). This formation of the crystallographic texture is associated with the elongated particle shape along the rolling direction (cf. FIG. 3 and FIG. 9). In comparison, no preferred crystallographic direction along the normal to the metal sheet is evident from FIG. 7 (cf. FIG. 7 and FIG. 11). The pole figures (FIG. 8) have an intensity maximum of 2.0, but this is to be regarded as a very weak intensity maximum in comparison with the intensity maximum of 4.7 in the pole figures for the rolled metal sheet (FIG. 12). The cause of the occurrence of an intensity maximum of 2.0 is to be sought much more in the measuring statistics than in the actual crystallographic texture of the material. It should be taken into account that there is no generally recognized method for the quantitative comparison of textures. Rather, the person skilled in the art is reliant on comparative measurements and his professional interpretation. It is in particular a microstructure where (I) the distribution of the crystallographic orientations varies by less than 30 percent over each surface parallel to the area normal, and (II) the distribution of the crystallographic orientations varies by less than 30 percent over each plane perpendicular to the area normal. The crystallographic orientations present are usually the <100> and <110> orientations. It is in particular a microstructure where (I) the distribution of the <100> and <110> orientation varies by less than percent over each surface parallel to the area normal, and (II) the distribution of the <100> and <110> orientations varies by less than 30 percent over each plane perpendicular to the area normal. The thickness of the metal sheets described is advantageously less than 1.5 mm, in particular less than 0.5 mm, especially less than 0.4 mm. A further property of the shaped articles according to the invention is that the strength and flexibility are direction-independent.

The open porosity of the shaped articles according to the invention is small and is 20% or less.

The shaped articles contain the above-described materials as metallic binder. Iron should not be used if the metal is to be nonmagnetic.

EXAMPLES

Example 1

Figure 3:
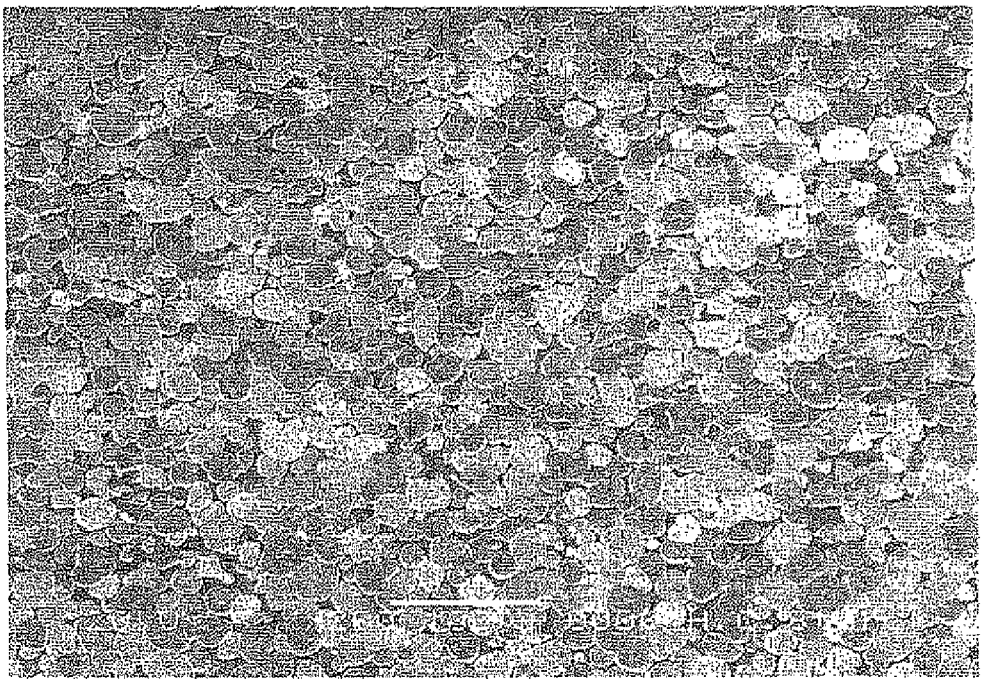
FIG. 3 depicts the microstructure of a tungsten heavy metal sheet in accordance with various embodiments of the invention, the vertical of the image being parallel to the normal to the metal sheet and the horizontal of the image being parallel to the drawing direction.
Figure 4:
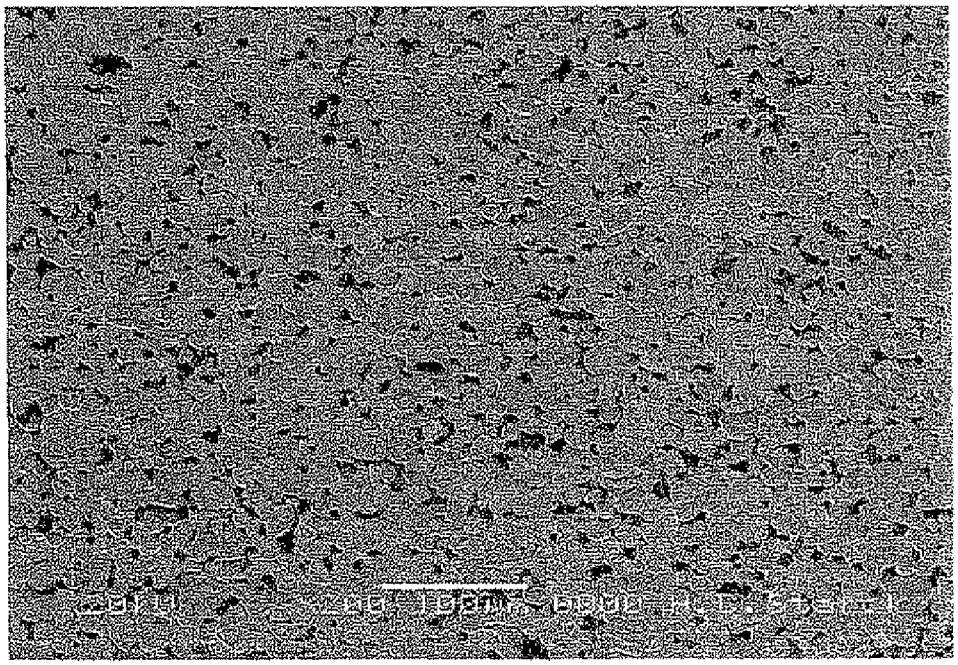
FIG. 4 depicts the microstructure of a tungsten heavy metal sheet in accordance with various embodiments of the invention, the vertical of the image being parallel to the normal to the metal sheet and the horizontal of the image being parallel to the transverse direction.

50 kg of an alloy powder having the composition W-0.2% Fe-5.3% Ni-2.1% Cu-0.2% Fe was used for the production of a tungsten heavy metal sheet. The powder had a specific surface area of 0.6 $m^2/g$ and a particle size of less than 63 μm. The alloy powder was milled and homogenized in a ball mill with 0.3 kg of polyester/polyamine condensation polymer (UNIQEMA Hypermer KD1) and 2.3 1 of a mixture of 31.8% by volume of ethanol and 68.2% by volume of ethyl methyl ketone for 24 hours in a ball mill. Thereafter, an amount of 2.5 kg of a mixture of 0.7 kg of polyvinyl butyral (Kuraray Mowital SB 45 H), 0.7 kg of benzyl phthalate (FERRO Santicizer 261A) and 1.5 1 of a mixture of 31.8% by volume of ethanol and 68.2% by volume of ethyl methyl ketone as a solvent was added and homogenization was effected for a further 24 hours. The mixture was then conditioned and degassed in casting batches. The slip obtained had a viscosity of 3.5 Pa·s. The density of the slip was 7 $g/cm^3$. The slip was then drawn on a casting unit with the use of a double-chamber casting shoe on a silicone-coated PET film at a drawing speed of 30 m/h to a strip having a length of 15 m, a width of 40 cm and a thickness of 1100 μm and dried at a temperature of 35° C. for 24 hours. The green foil obtained was then freed from binder in a vacuum of 50 mbar and with a temperature profile shown in FIG. 2. The presintered material obtained was sintered at a temperature of 1485° C. for 2 hours in a hydrogen atmosphere. FIG. 3 shows the microstructure of the tungsten heavy metal sheet obtained, the vertical of the image being parallel to the normal to the metal sheet and the horizontal of the image being parallel to the drawing direction. FIG. 4 shows the micro-structure of the tungsten heavy metal sheet obtained, the vertical of the image being parallel to the normal to the metal sheet and the horizontal of the image being parallel to the transverse direction. In both images, it is evident that there is no directional dependence of the particle shape and the tungsten particles have a substantially round appearance in both sectional planes.

The metal sheet obtained was rolled at 1200° C. and then annealed for 2 hours at a temperature of 800° C. in a reducing atmosphere. The tungsten heavy metal sheet obtained contained 92.4% of tungsten and 7.6% of the metallic binder. The metal sheet had a density of 17.5 $g/cm^3$.

Figure 5:
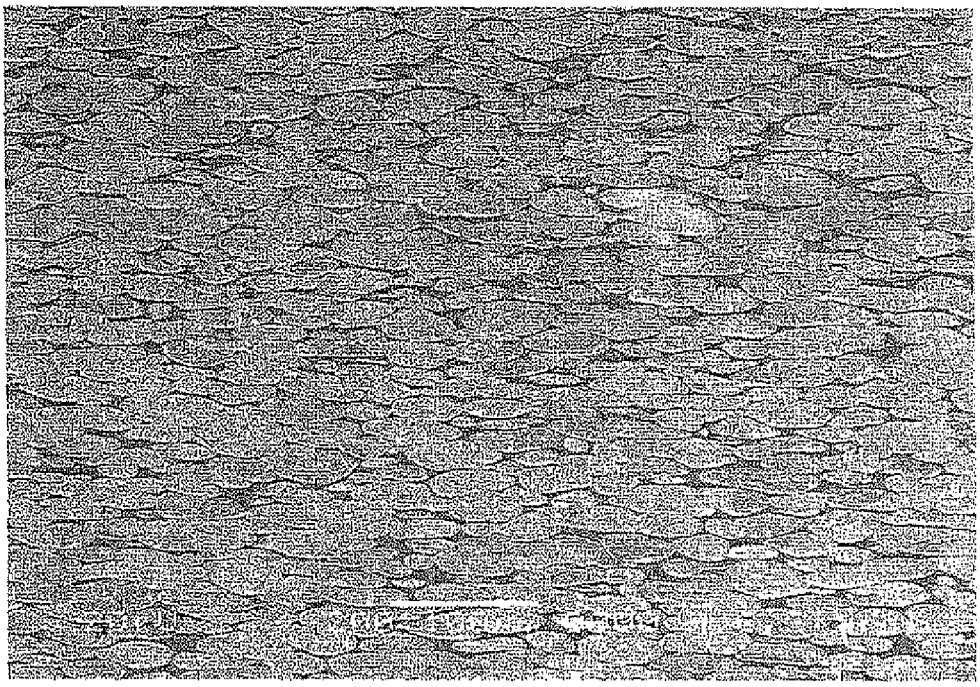
FIG. 5 depicts the microstructure of a rolled tungsten heavy metal sheet in accordance with various embodiments of the invention, the vertical of the image being parallel to the normal to the metal sheet and the horizontal of the image being parallel to the rolling direction.
Figure 6:
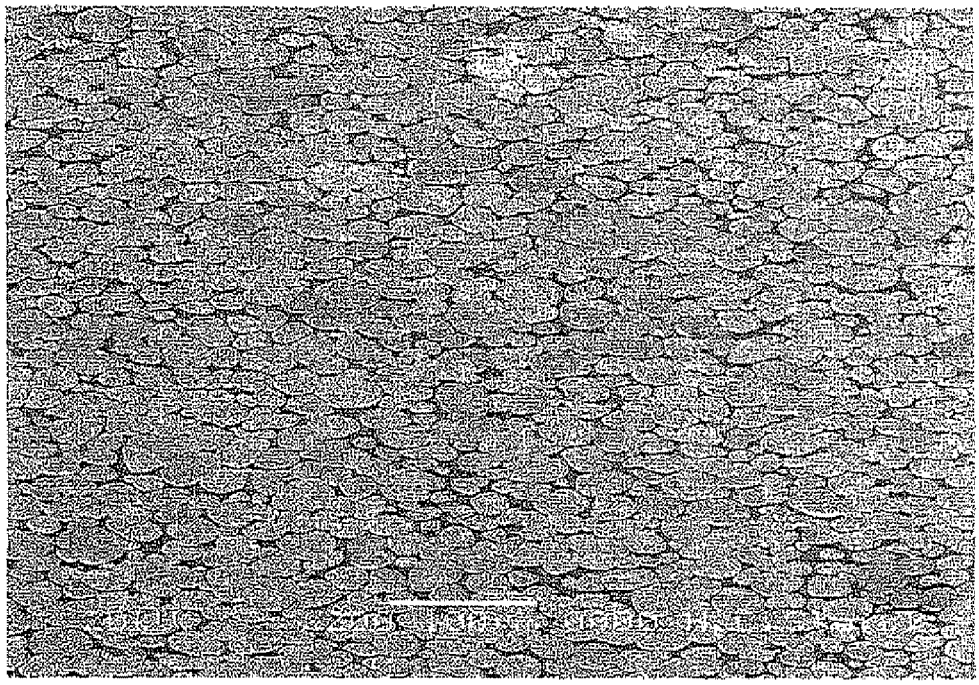
FIG. 6 depicts the microstructure of a rolled tungsten heavy metal sheet in accordance with various embodiments of the invention, the vertical of the image being parallel to the normal to the metal sheet and the horizontal to the image being parallel to the transverse direction.

FIGS. 5 and 6 show images of the microstructure of the tungsten heavy metal sheet obtained, FIG. 5 with the vertical of the image parallel to the normal to the metal sheet and the horizontal of the image parallel to the rolling direction, FIG. 5 with the verticals of the image parallel to the normals to the metal sheet and the horizontal to the image parallel to the transverse direction. In FIG. 5, slight stretching is evident; in FIG. 6, a flattening of the particles is evident.

Figure 7:
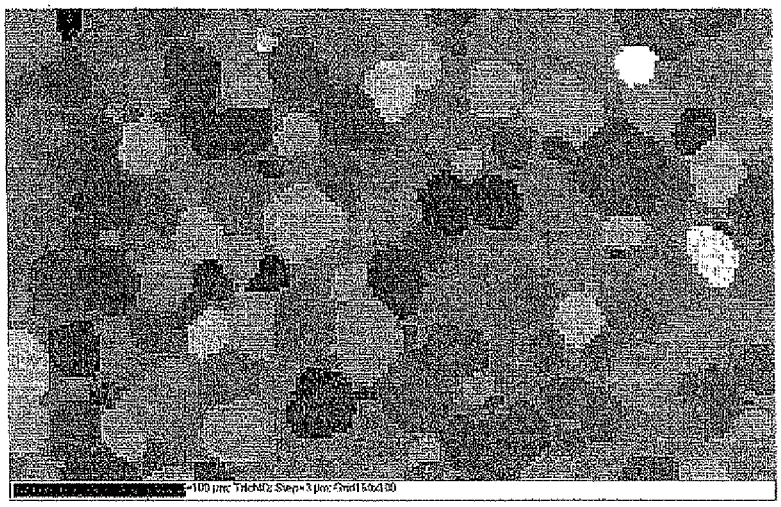
FIG. 7 depicts the crystallographic texture of a tungsten heavy metal sheet in accordance with various embodiments of the invention, as determined by EBSD (Electron Back-Scatter Diffraction) measurements.

The crystallographic texture was determined by EBSD (Electron Back-Scatter Diffraction) measurements. FIG. 7 shows the microstructure (cf. FIG. 3), the color of the tungsten particles indicating the crystal direction of the particle which is parallel to the normal direction of the metal sheet (cf. in this context FIG. 7*a*: color code). FIG. 7 shows a uniform distribution of all colors, so that no preferred crystallographic direction with regard to the normals to the metal sheets is detectable.

Figure 8:
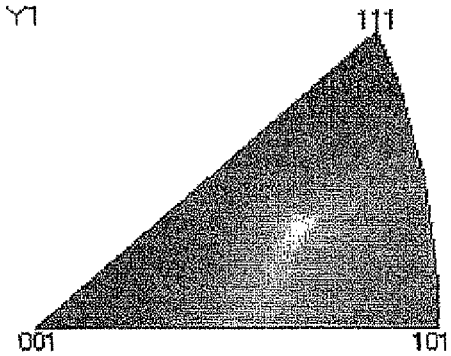
FIG. 8 depicts the crystallographic texture of a tungsten heavy metal sheet in accordance with various embodiments of the invention in the form of pole figures.
Figure 8:
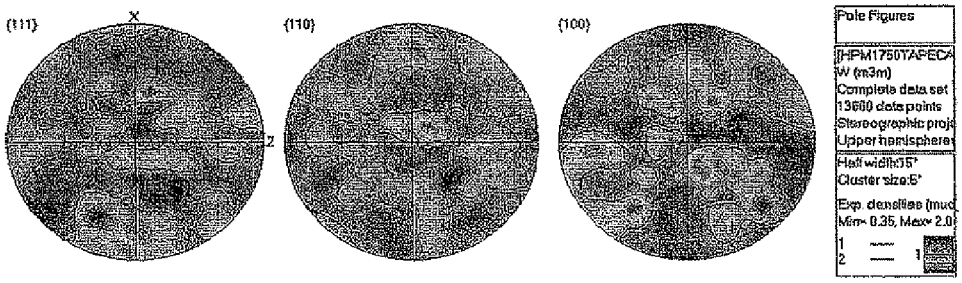

FIG. 8 shows the texture in the form of pole figures. FIG. 8 shows a relatively turbulent structure without detectable rolling texture.

Comparative Example

A tungsten heavy metal sheet having a density of 17.5 $g/cm^3$ which was obtained by rolling and contained an amount of 92.4% of tungsten and 7.6% of metallic binder was investigated analogously.

For this purpose, element powders having the composition W-0.2% Fe-5.3% Ni-2.1% Cu-0.2% Fe were mixed and milled in a ball mill. Thereafter, the powder mixture was subjected to isostatic pressing at 1500 bar and then sintered at 1450° C. in a hydrogen atmosphere. A panel of sintered material about 10 mm thick was brought to a thickness of about 1 mm by repeated hot/warm rolling by in each case about 20% with subsequent annealing treatment in each case. The preliminary annealing temperature of about 1300° C. at 10 mm thickness is reduced with decreasing thickness. In the final rolling step, preheating is effected only at about 300° C.

Figure 9:
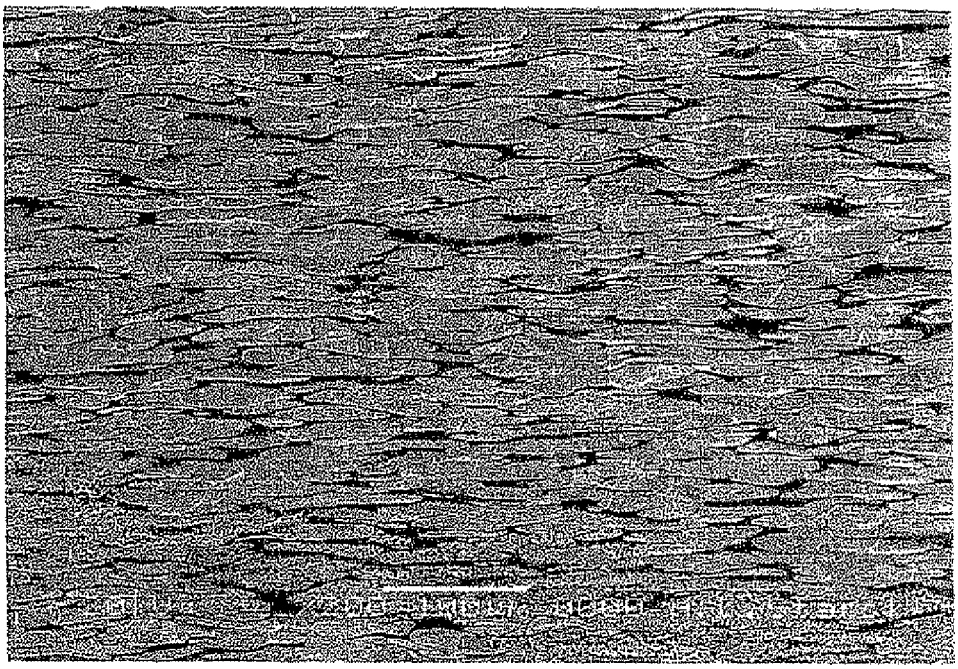
FIG. 9 depicts the microstructure of a comparative tungsten heavy metal sheet, the vertical of the image being parallel to the normal to the metal sheet and the horizontal of the image being parallel to the rolling direction.
Figure 10:
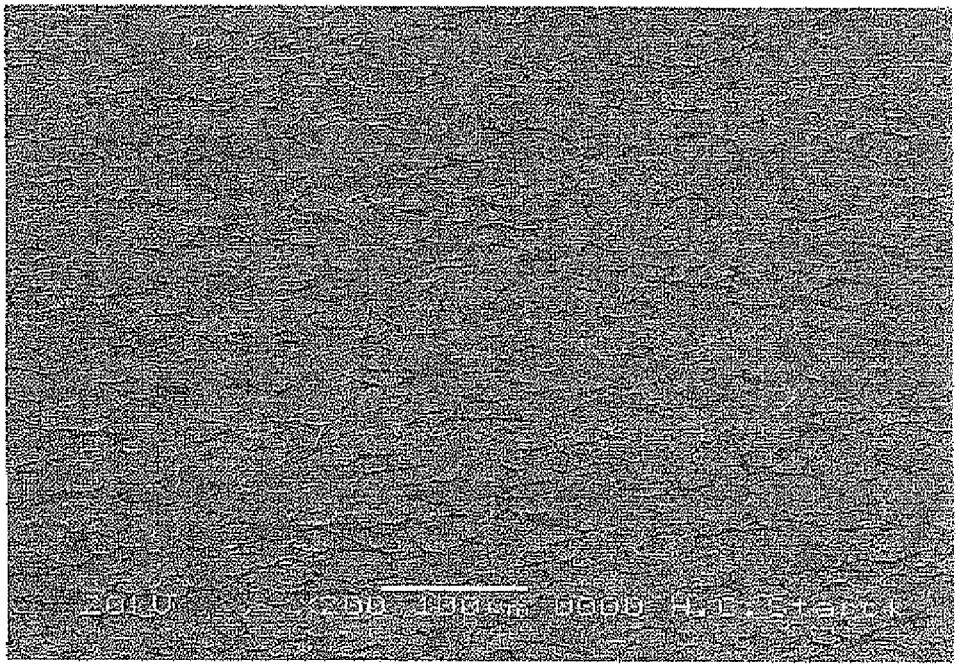
FIG. 10 depicts the microstructure of a comparative tungsten heavy metal sheet, the vertical of the image being parallel to the normal to the metal sheet and the horizontal of the image being parallel to the transverse direction.

FIG. 9 shows the microstructure of the tungsten heavy metal sheet obtained, the vertical of the image being parallel to the normal to the metal sheet and the horizontal of the image being parallel to the rolling direction. FIG. 10 shows the microstructure of the tungsten heavy metal sheet obtained, the vertical of the image being parallel to the normal to the metal sheet and the horizontal of the image being parallel to the transverse direction. In both images, it is clear that the tungsten particles were stretched in the rolling direction by the rolling process. FIG. 10 shows the microstructure transverse to the rolling direction. The tungsten particles are slightly flattened.

The crystallographic texture was determined by EBSD (Electron Back-Scatter Diffraction) measurements. FIG. 8 shows the microstructure (cf. FIG. 9), the color of the tungsten particles indicating the crystal direction of the particle which is parallel to the normal direction of the metal sheet (cf. in this context FIG. 7*a*: color code). In contrast to FIG. 7, red and blue colors dominate in FIG. 11. It is evident from this that the stretched tungsten particles preferably have <100> and <110> directions oriented parallel to the normals to the metal sheets.

FIG. 12 shows the texture in the form of pole figures. In FIG. 12, in contrast to FIG. 8, the substantial difference between transverse and rolling direction is evident. Therefore, owing to the orientation of the tungsten particles, the metal sheet has anisotropic material properties within the plane of the metal sheet.

Table 1 below shows further examples of compositions which are processed as in Example 1 to give metal sheets. In percent by weight, tungsten is added in a total amount to make up to 100% by weight (indicated by "to 100").

TABLE 2

Table 2 consists of 136 metal sheets, molybdenum being used instead of tungsten and the content of the metallic binder components nickel, iron, copper, cobalt, manganese or aluminum being stated as in Table 1 in percent by weight.

| No. | Tungsten content/% by weight | Nickel content/% by weight | Iron content/% by weight | Copper content/% by weight | Cobalt content/% by weight | Manganese content/% by weight | Aluminum content/% by weight |
|---|---|---|---|---|---|---|---|
| 1 | to 100 | 25 | 15 | | | | |
| 2 | to 100 | 25 | 15 | | | | 0.1 |
| 3 | to 100 | 15 | 5 | | | | |
| 4 | to 100 | 15 | 5 | | | | 0.1 |
| 5 | to 100 | 5 | 2.5 | 2 | 0 | 0 | 0 |
| 6 | to 100 | 5 | 2.5 | 2 | 0.1 | | |
| 7 | to 100 | 5 | 2.5 | 2 | | 0.05 | |
| 8 | to 100 | 5 | 2.5 | 2 | 0.1 | 0.05 | |
| 9 | to 100 | 5 | 2.5 | 2 | 0.2 | | |
| 10 | to 100 | 5 | 2.5 | 2 | | 0.1 | |
| 11 | to 100 | 5 | 2.5 | 2 | 0.2 | 0.1 | |
| 12 | to 100 | 5 | 2.5 | 2 | 1.9 | 0.1 | |
| 13 | to 100 | 5 | 2.5 | 2 | 1.9 | | |
| 14 | to 100 | 5 | 2.5 | 2 | | | 0.1 |
| 15 | to 100 | 6 | 0.2 | 2.5 | 0 | 0 | 0 |
| 16 | to 100 | 6 | 0.2 | 2.5 | 0.1 | | |
| 17 | to 100 | 6 | 0.2 | 2.5 | | 0.05 | |
| 18 | to 100 | 6 | 0.2 | 2.5 | 0.1 | 0.05 | |
| 19 | to 100 | 6 | 0.2 | 2.5 | 0.2 | | |
| 20 | to 100 | 6 | 0.2 | 2.5 | | 0.1 | |
| 21 | to 100 | 6 | 0.2 | 2.5 | 0.2 | 0.1 | |
| 22 | to 100 | 6 | 0.2 | 2.5 | 1.9 | 0.1 | |
| 23 | to 100 | 6 | 0.2 | 2.5 | 1.9 | | |
| 24 | to 100 | 6 | 0.2 | 2.5 | | | 0.1 |
| 25 | to 100 | 7 | 0 | 3 | 0 | 0 | 0 |
| 26 | to 100 | 7 | 0 | 3 | 0.1 | | |
| 27 | to 100 | 7 | 0 | 3 | | 0.05 | |
| 28 | to 100 | 7 | 0 | 3 | 0.1 | 0.05 | |
| 29 | to 100 | 7 | 0 | 3 | 0.2 | | |
| 30 | to 100 | 7 | 0 | 3 | | 0.1 | |
| 31 | to 100 | 7 | 0 | 3 | 0.2 | 0.1 | |
| 32 | to 100 | 7 | 0 | 3 | 1.9 | 0.1 | |
| 33 | to 100 | 7 | 0 | 3 | 1.9 | | |
| 34 | to 100 | 7 | 0 | 3 | | | 0.1 |
| 35 | to 100 | 7 | 0.15 | 2.8 | 0 | 0 | 0 |
| 36 | to 100 | 7 | 0.15 | 2.8 | 0.1 | | |
| 37 | to 100 | 7 | 0.15 | 2.8 | | 0.05 | |
| 38 | to 100 | 7 | 0.15 | 2.8 | 0.1 | 0.05 | |
| 39 | to 100 | 7 | 0.15 | 2.8 | 0.2 | | |
| 40 | to 100 | 7 | 0.15 | 2.8 | | 0.1 | |
| 41 | to 100 | 7 | 0.15 | 2.8 | 0.2 | 0.1 | |
| 42 | to 100 | 7 | 0.15 | 2.8 | 1.9 | 0.1 | |
| 43 | to 100 | 7 | 0.15 | 2.8 | 1.9 | | |
| 44 | to 100 | 7 | 0.15 | 2.8 | | | 0.1 |
| 45 | to 100 | 5 | 2 | 0 | 0 | 0 | 0 |
| 46 | to 100 | 5 | 2 | 0 | 0.1 | | |
| 47 | to 100 | 5 | 2 | 0 | | 0.05 | |
| 48 | to 100 | 5 | 2 | 0 | 0.1 | 0.05 | |
| 49 | to 100 | 5 | 2 | 0 | 0.2 | | |
| 50 | to 100 | 5 | 2 | 0 | | 0.1 | |
| 51 | to 100 | 5 | 2 | 0 | 0.2 | 0.1 | |
| 52 | to 100 | 5 | 2 | 0 | 1.9 | 0.1 | |
| 53 | to 100 | 5 | 2 | 0 | 1.9 | | |
| 54 | to 100 | 5 | 2 | 0 | | | 0.1 |
| 55 | to 100 | 3.5 | 1.5 | 0 | 0 | 0 | 0 |
| 56 | to 100 | 3.5 | 1.5 | 0 | 0.1 | | |
| 57 | to 100 | 3.5 | 1.5 | 0 | | 0.05 | |
| 58 | to 100 | 3.5 | 1.5 | 0 | 0.1 | 0.05 | |
| 59 | to 100 | 3.5 | 1.5 | 0 | 0.2 | | |
| 60 | to 100 | 3.5 | 1.5 | 0 | | 0.1 | |
| 61 | to 100 | 3.5 | 1.5 | 0 | 0.2 | 0.1 | |
| 62 | to 100 | 3.5 | 1.5 | 0 | 1.9 | 0.1 | |
| 63 | to 100 | 3.5 | 1.5 | 0 | 1.9 | | |
| 64 | to 100 | 3.5 | 1.5 | 0 | | | 0.1 |
| 65 | to 100 | 2 | 1.2 | 0.95 | 0 | 0 | 0 |
| 66 | to 100 | 2 | 1.2 | 0.95 | 0.1 | | |
| 67 | to 100 | 2 | 1.2 | 0.95 | | 0.05 | |
| 68 | to 100 | 2 | 1.2 | 0.95 | 0.1 | 0.05 | |
| 69 | to 100 | 2 | 1.2 | 0.95 | 0.2 | | |
| 70 | to 100 | 2 | 1.2 | 0.95 | | 0.1 | |
| 71 | to 100 | 2 | 1.2 | 0.95 | 0.2 | 0.1 | |
| 72 | to 100 | 2 | 1.2 | 0.95 | 1.9 | 0.1 | |

TABLE 2-continued

Table 2 consists of 136 metal sheets, molybdenum being used instead of tungsten and the content of the metallic binder components nickel, iron, copper, cobalt, manganese or aluminum being stated as in Table 1 in percent by weight.

| No. | Tungsten content/% by weight | Nickel content/% by weight | Iron content/% by weight | Copper content/% by weight | Cobalt content/% by weight | Manganese content/% by weight | Aluminum content/% by weight |
|---|---|---|---|---|---|---|---|
| 73 | to 100 | 2 | 1.2 | 0.95 | 1.9 | | |
| 74 | to 100 | 2 | 1.2 | 0.95 | | | 0.1 |
| 75 | to 100 | 3.4 | 1.4 | 0 | 0 | 0 | 0 |
| 76 | to 100 | 3.4 | 1.4 | 0 | 0.1 | | |
| 77 | to 100 | 3.4 | 1.4 | 0 | | 0.05 | |
| 78 | to 100 | 3.4 | 1.4 | 0 | 0.1 | 0.05 | |
| 79 | to 100 | 3.4 | 1.4 | 0 | 0.2 | | |
| 80 | to 100 | 3.4 | 1.4 | 0 | | 0.1 | |
| 81 | to 100 | 3.4 | 1.4 | 0 | 0.2 | 0.1 | |
| 82 | to 100 | 3.4 | 1.4 | 0 | 1.9 | 0.1 | |
| 83 | to 100 | 3.4 | 1.4 | 0 | 1.9 | | |
| 84 | to 100 | 3.4 | 1.4 | 0 | | | 0.1 |
| 85 | to 100 | 3 | 1.3 | 0 | 0 | 0 | 0 |
| 86 | to 100 | 3 | 1.3 | 0 | 0.1 | | |
| 87 | to 100 | 3 | 1.3 | 0 | | 0.05 | |
| 88 | to 100 | 3 | 1.3 | 0 | 0.1 | 0.05 | |
| 89 | to 100 | 3 | 1.3 | 0 | 0.2 | | |
| 90 | to 100 | 3 | 1.3 | 0 | | 0.1 | |
| 91 | to 100 | 3 | 1.3 | 0 | 0.2 | 0.1 | |
| 92 | to 100 | 3 | 1.3 | 0 | 1.9 | 0.1 | |
| 93 | to 100 | 3 | 1.3 | 0 | 1.9 | | |
| 94 | to 100 | 3 | 1.3 | 0 | | | 0.1 |
| 95 | to 100 | 4.4 | 0.7 | 0.1 | 0 | 0 | 0 |
| 96 | to 100 | 4.4 | 0.7 | 0.1 | 0.1 | | |
| 97 | to 100 | 4.4 | 0.7 | 0.1 | | 0.05 | |
| 98 | to 100 | 4.4 | 0.7 | 0.1 | 0.1 | 0.05 | |
| 99 | to 100 | 4.4 | 0.7 | 0.1 | 0.2 | | |
| 100 | to 100 | 4.4 | 0.7 | 0.1 | | 0.1 | |
| 101 | to 100 | 4.4 | 0.7 | 0.1 | 0.2 | 0.1 | |
| 102 | to 100 | 4.4 | 0.7 | 0.1 | 1.9 | 0.1 | |
| 103 | to 100 | 4.4 | 0.7 | 0.1 | 1.9 | | |
| 104 | to 100 | 4.4 | 0.7 | 0.1 | | | 0.1 |
| 105 | to 100 | 3.5 | 0.1 | 1.4 | 0 | 0 | 0 |
| 106 | to 100 | 3.5 | 0.1 | 1.4 | 0.1 | | |
| 107 | to 100 | 3.5 | 0.1 | 1.4 | | 0.05 | |
| 108 | to 100 | 3.5 | 0.1 | 1.4 | 0.1 | 0.05 | |
| 109 | to 100 | 3.5 | 0.1 | 1.4 | 0.2 | | |
| 110 | to 100 | 3.5 | 0.1 | 1.4 | | 0.1 | |
| 111 | to 100 | 3.5 | 0.1 | 1.4 | 0.2 | 0.1 | |
| 112 | to 100 | 3.5 | 0.1 | 1.4 | 1.9 | 0.1 | |
| 113 | to 100 | 3.5 | 0.1 | 1.4 | 1.9 | | |
| 114 | to 100 | 3.5 | 0.1 | 1.4 | | | 0.1 |
| 115 | to 100 | 1.5 | 1.5 | 0 | 0 | 0 | 0 |
| 116 | to 100 | 1.5 | 1.5 | 0 | 0.1 | | |
| 117 | to 100 | 1.5 | 1.5 | 0 | | 0.05 | |
| 118 | to 100 | 1.5 | 1.5 | 0 | 0.1 | 0.05 | |
| 119 | to 100 | 1.5 | 1.5 | 0 | 0.2 | | |
| 120 | to 100 | 1.5 | 1.5 | 0 | | 0.1 | |
| 121 | to 100 | 1.5 | 1.5 | 0 | 0.2 | 0.1 | |
| 122 | to 100 | 1.5 | 1.5 | 0 | 1.9 | 0.1 | |
| 123 | to 100 | 1.5 | 1.5 | 0 | 1.9 | | |
| 124 | to 100 | 1.5 | 1.5 | 0 | | | 0.1 |
| 125 | to 100 | 2.1 | 0.9 | 0 | 0 | 0 | 0 |
| 126 | to 100 | 2.1 | 0.9 | 0 | 0.1 | | |
| 127 | to 100 | 2.1 | 0.9 | 0 | | 0.05 | |
| 128 | to 100 | 2.1 | 0.9 | 0 | 0.1 | 0.05 | |
| 129 | to 100 | 2.1 | 0.9 | 0 | 0.2 | | |
| 130 | to 100 | 2.1 | 0.9 | 0 | | 0.1 | |
| 131 | to 100 | 2.1 | 0.9 | 0 | 0.2 | 0.1 | |
| 132 | to 100 | 2.1 | 0.9 | 0 | 1.9 | 0.1 | |
| 133 | to 100 | 2.1 | 0.9 | 0 | 1.9 | | |
| 134 | to 100 | 2.1 | 0.9 | 0 | | | 0.1 |
| 135 | to 100 | 2.1 | 0.9 | 0 | | | |
| 136 | to 100 | 2.1 | 0.9 | 0 | | | |

The invention claimed is:

1. A method for fabricating an article comprising a tungsten heavy metal alloy or a molybdenum alloy, the method comprising:

mixing a metal powder with a first organic solvent and a dispersant to obtain a first mixture, the metal powder comprising a tungsten heavy metal alloy or a molybdenum alloy;

homogenizing the first mixture;

mixing the first mixture with a polymeric binder and a second organic solvent to form a second mixture;

homogenizing the second mixture;

casting a foil of the second mixture on a substrate;

drying the cast foil;

removing organic constituents of the second mixture from the foil; and thereafter, sintering the foil to obtain a metal sheet comprising the tungsten heavy metal alloy or the molybdenum alloy.

2. The method of claim 1, wherein forming the first mixture comprises mixing polymeric binder with the metal powder, the first organic solvent, and the dispersant.

3. The method of claim 1, wherein forming the second mixture comprises mixing a plasticizer with the first mixture, the polymeric binder, and the second organic solvent, whereby the plasticizer reduces a glass transition temperature of the polymeric binder.

4. The method of claim 3, wherein the plasticizer comprises benzyl phthalate.

5. The method of claim 1, wherein the second organic solvent and the first organic solvent are the same.

6. The method of claim 1, wherein the second organic solvent is different from the first organic solvent.

7. The method of claim 1, wherein the second organic solvent and the first organic solvent form an azeotropic mixture in the second mixture.

8. The method of claim 1, wherein before casting the second mixture has a solids content of about 30 percent by volume to about 60 percent by volume.

9. The method of claim 1, wherein before casting a viscosity of the second mixture in the range from 1 Pa·s to 7 Pa·s.

10. The method of claim 1, wherein casting the foil comprises (i) disposing the second mixture over the substrate, (ii) drawing the substrate beneath a first casting blade disposed over the substrate by a first height, and (iii) thereafter, drawing the substrate beneath a second casting blade disposed over the substrate by a second height less than the first height.

11. The method of claim 1, further comprising bending the metal sheet to form a shaped article.

12. The method of claim 1, wherein the dispersant comprises at least one of a polyester/polyamine condensation polymer, fish oil, or an alkyl phosphate compound.

13. The method of claim 1, wherein drying the cast foil comprises drawing the substrate with the cast foil thereon through a drying tunnel, a drying temperature applied within the drying tunnel drying the cast foil.

14. The method of claim 13, wherein the drying temperature is selected from the range of 25° C. to 70° C.

15. The method of claim 13, further comprising flowing air countercurrently through the drying tunnel during drying of the cast foil.

16. The method of claim 1, wherein (i) the foil is sintered at a sintering temperature, and (ii) the foil is disposed on a sintering substrate during sintering, the sintering substrate being unreactive with the tungsten heavy metal alloy or molybdenum alloy at the sintering temperature.

17. The method of claim 16, wherein the sintering substrate comprises alumina, aluminum nitride, boron nitride, silicon carbide, or zirconium oxide.

18. The method of claim 1, wherein a thickness of the metal sheet is less than 1.5 mm without rolling.

19. The method of claim 1, wherein removing organic constituents of the second mixture from the foil comprises removing polymeric binder from the foil.

20. The method of claim 1, wherein removing organic constituents of the second mixture from the foil comprises heating the foil at a temperature up to 600° under a pressure of 50-150 mbar.

21. The method of claim 1, wherein removing organic constituents of the second mixture from the foil comprises flushing an atmosphere around the foil with a gas comprising nitrogen with 2% by volume or less of hydrogen.

22. The method of claim 3, wherein removing organic constituents of the second mixture from the foil comprises removing plasticizer from the foil.

23. A method for fabricating an article comprising a tungsten heavy metal alloy or a molybdenum alloy, the method comprising:

mixing a metal powder with at least one organic solvent, a dispersant, and a polymeric binder to obtain a slip, the metal powder comprising a tungsten heavy metal alloy or a molybdenum alloy;

casting a foil of the slip on a substrate by (i) disposing the slip over the substrate, (ii) drawing the substrate beneath a first casting blade disposed over the substrate by a first height, and (iii) thereafter, drawing the substrate beneath a second casting blade disposed over the substrate by a second height less than the first height;

drying the cast foil; and thereafter, sintering the foil to obtain a metal sheet comprising the tungsten heavy metal alloy or the molybdenum alloy.

24. The method of claim 23, further comprising, before sintering the foil, removing organic constituents from the foil.

25. The method of claim 23, wherein obtaining the slip comprises:

mixing the metal powder with a first organic solvent and the dispersant to obtain a first mixture;

homogenizing the first mixture;

mixing the first mixture with the polymeric binder and a second organic solvent to form a second mixture; and homogenizing the second mixture.

26. The method of claim 23, wherein drying the cast foil comprises drawing the substrate with the cast foil thereon through a drying tunnel, a drying temperature applied within the drying tunnel drying the cast foil.

27. The method of claim 26, wherein the drying temperature is selected from the range of 25° C. to 70° C.

28. The method of claim 26, further comprising flowing air countercurrently through the drying tunnel during drying of the cast foil.

29. The method of claim 24, wherein removing organic constituents from the foil comprises removing polymeric binder from the foil.

* * * * *